US011092386B2

(12) United States Patent
Meyer, IV et al.

(10) Patent No.: US 11,092,386 B2
(45) Date of Patent: Aug. 17, 2021

(54) MANUFACTURING METHOD AND STRUCTURE OF HEAT PIPE WITH ADJUSTABLE WORKING TEMPERATURE RANGE

(71) Applicant: Celsia Technologies Taiwan, Inc., Taoyuan (TW)

(72) Inventors: George A. Meyer, IV, Morgan Hill, CA (US); Chien-Hung Sun, Taoyuan County (TW)

(73) Assignee: CELSIA TECHNOLOGIES TAIWAN, INC., Taoyuan (TW)

( * ) Notice: Subject to any disclaimer, the term of this patent is extended or adjusted under 35 U.S.C. 154(b) by 50 days.

(21) Appl. No.: 16/546,568

(22) Filed: Aug. 21, 2019

(65) Prior Publication Data

US 2021/0055060 A1 Feb. 25, 2021

(51) Int. Cl.

| | |
|---|---|
| ***F28D 15/06*** | (2006.01) |
| ***B21D 53/02*** | (2006.01) |
| ***F28D 15/04*** | (2006.01) |
| ***F28D 15/02*** | (2006.01) |

(52) U.S. Cl.

CPC ..... *F28D 15/06* (2013.01); *B21D 53/02* (2013.01); *F28D 15/0241* (2013.01); *F28D 15/04* (2013.01)

(58) Field of Classification Search

CPC ..... B21D 53/02; F28D 15/06; F28D 15/04; F28D 15/0275; F28D 15/0283; B23P 2700/09

See application file for complete search history.

(56) References Cited

U.S. PATENT DOCUMENTS 6,508,302 B2 * 1/2003 Ishida ..... B21C 37/151 165/104.21
2010/0083500 A1 * 4/2010 Lin ..... F28D 15/0275 29/890.03
2010/0319899 A1 * 12/2010 Yokoyama ..... H01L 21/4882 165/185

(Continued)

FOREIGN PATENT DOCUMENTS

CN 102914194 A 2/2013
TW 200819698 A 5/2008

OTHER PUBLICATIONS

Office Action dated Nov. 28, 2019 of the corresponding Taiwan patent application No. 108120184.

*Primary Examiner* — Gordon A Jones
(74) *Attorney, Agent, or Firm* — Chun-Ming Shih; HDLS IPR Services

(57) ABSTRACT

A manufacturing method and structure of heat pipe with adjustable working temperature range are provided. The heat pipe includes a tube, a capillary structure and a working liquid. The tube includes a passage having a length direction and a diameter direction. Besides, a part of the tube has a pressed deformation zone in the pipe diameter direction, and the pressed cross-sectional area of the deformation zone in the diameter direction is reduced by a reduction ratio with respect to an original cross-sectional area before pressing, so that the deformation zone has a higher fluid resistance. Thereby, the heat pipe can be operated under a certain working temperature range, and the working object can achieve the working efficiency.

6 Claims, 3 Drawing Sheets

(56) References Cited

U.S. PATENT DOCUMENTS

| | | | | |
|---|---|---|---|---|
| 2013/0037241 | A1* | 2/2013 | Lin | F28D 15/046 165/104.26 |
| 2013/0118717 | A1* | 5/2013 | Lin | F28D 15/0233 165/104.26 |
| 2017/0153067 | A1* | 6/2017 | Lo | B21C 37/154 |
| 2021/0055060 | A1* | 2/2021 | Meyer, IV | F28D 15/0241 |

* cited by examiner

MANUFACTURING METHOD AND STRUCTURE OF HEAT PIPE WITH ADJUSTABLE WORKING TEMPERATURE RANGE

BACKGROUND OF THE INVENTION

Field of the Invention

The present invention generally relates to a heat pipe and, in particular to a manufacturing method and structure of heat pipe with adjustable working temperature range.

Description of Related Art

A heat pipe is provided with a vacuum tube filled with a working fluid inside. The working principle of the heat pipe is that the working fluid has a phase change after being heated for heat exchange, and then the working fluid will be cooled to return back to a liquid state to be recirculated to use. The implement method of the heat pipe is to put the evaporation section of the heat pipe attached on a heating electronic element, so that the heat of the electronic component is absorbed by the evaporation section of the heat pipe, and then the heat will be transmitted to the condensation section through the heat pipe, thereby the heat dissipation effect can be achieved.

Moreover, the existing heat pipe has a very small temperature difference between the evaporation section and the condensation section to achieve a good heat dissipation efficiency; thus the heat exchange of the working object is carried out through the phase change of the working fluid, and the working object can be prevented from damages of overheating or a deteriorated system efficiency. However, in some special environments (such as in extremely cold environments), electronic components may not be able to achieve a proper operating temperature due to the small temperature difference, and that may lead to electronic components cannot maximize their performance.

Therefore, the purpose of the present invention is to provide a heat pipe which can be operated at a certain temperature, so that the heat pipe will not be operated under a low ambient temperature and the electronic component having a low heating temperature; on the other hand, the heat pipe will start to be operated while the electronic component having a high heating temperature.

SUMMARY OF THE INVENTION

Accordingly, an object of the present invention is to provide a manufacturing method of heat pipe with adjustable working temperature range, so that the heat pipe can be operated at a certain working temperature range, and it can make the working object to achieve the work efficiency.

In order to achieve the object mentioned above, the present invention provides a manufacturing method of heat pipe with adjustable working temperature range, comprising: a) providing a heat pipe for attaching a working object for heat exchange; the heat pipe including a tube, a capillary structure disposed on an inner wall of the tube, and a working liquid disposed in the tube; the tube comprising a passage having a length direction and a diameter direction perpendicular to the length direction; the working liquid absorbing heat of the working object and converting into a vapor phase, and the working liquid passing the passage to perform a condensation reaction along the length direction and condensing back into the working liquid; the working liquid moving to a location where the working object attached thereto through the capillary structure and absorbing heat of the working object; b) pressing uniformly on a part of the tube in the pipe diameter direction by a means of processing to form a deformation zone, and a pressed cross-sectional area of the deformation zone after pressing in the diameter direction reduced by a reduction ratio with respect to an original cross-sectional area before pressing, so that the deformation zone has a higher fluid resistance, wherein the reduction ratio of the pressed cross-sectional area of the deformation zone in the diameter direction is determined by the following method: c) setting the heat pipe being capable of performing heat exchange of the working object in an ambient temperature range and making a working temperature of the working object to be in a target working temperature range; d) providing a testing chamber and disposing the heat pipe with the working object attached thereto, wherein a temperature of the testing chamber is controlled at the ambient temperature range; e) operating the working object at the ambient temperature range in the testing chamber and measuring an actual temperature range during the operation of the working object; and f) reducing a cross-sectional area of the passage in the pipe diameter direction by the reduction ratio, so that the actual temperature range will fall within the target working temperature range.

Accordingly, another object of the present invention is to provide a structure of heat pipe with adjustable working temperature range comprising a tube, a capillary structure disposed on an inner wall of the tube, and a working liquid disposed in the tube. The tube comprises a passage having a length direction and a diameter direction perpendicular to the length direction. The working liquid absorbs heat of the working object and converting into a vapor phase and passing the passage to perform a condensation reaction along the length direction and condensing back to the working liquid. The working liquid moves to a location where the working object attached thereto and absorbing heat of the working object; wherein a part of the tube has a deformation zone in the pipe diameter direction, and a cross-sectional area of the deformation zone in the diameter direction is reduced by a reduction ratio with respect to an original cross-sectional area before pressing, so that the deformation zone has a higher fluid resistance.

Comparing to the prior art, the heat pipe of the present invention has pressed uniformly on a part of the tube in the pipe diameter direction to form a deformation zone. In a low temperature environment, there is a high vapor flow resistance between the evaporation section and the condensation section, thus the temperature difference is increased, so that the heat pipe can be operated efficiently under a certain operating temperature range, and the working temperature of the working object can be increased to an appropriate working temperature to work. Moreover, when the heat pipe is in a high temperature environment, the working fluid has a large vapor volume at the high temperature, thus the internal pressure of the heat pipe will be increased and the working vapor is pushed from the evaporation section to the condensation section rapidly; thereby the heat transfer efficiency is improved, and the evaporation section and the condensation section will has a small temperature difference. Therefore, the heat pipe can be operated under a certain working temperature range, and the working object not only can be prevented from being overheated and damaged, but also the system performance efficiency will be remained.

BRIEF DESCRIPTION OF THE DRAWINGS

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
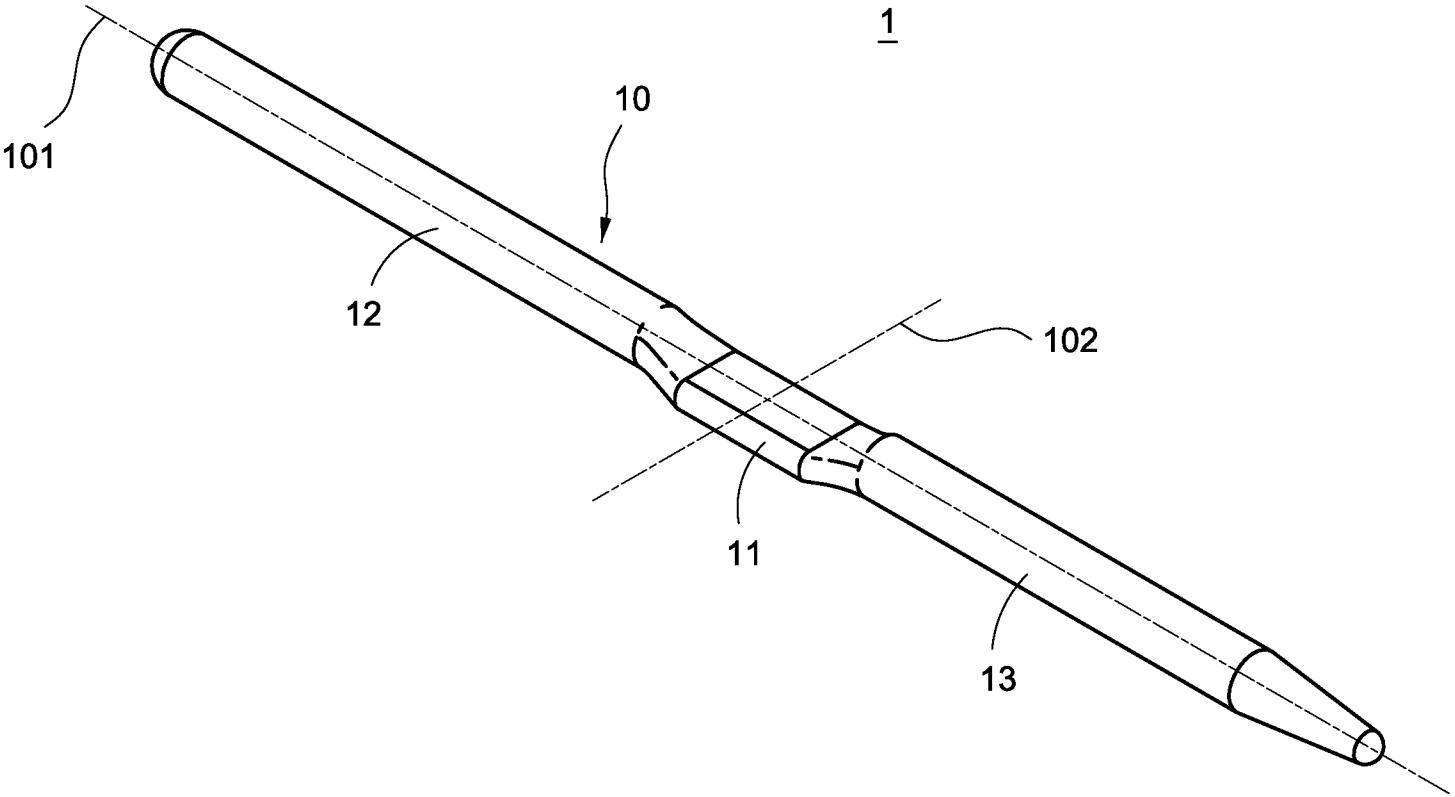
FIG. 1 is a perspective schematic view of heat pipe with adjustable working temperature range of the present invention.
Figure 2:
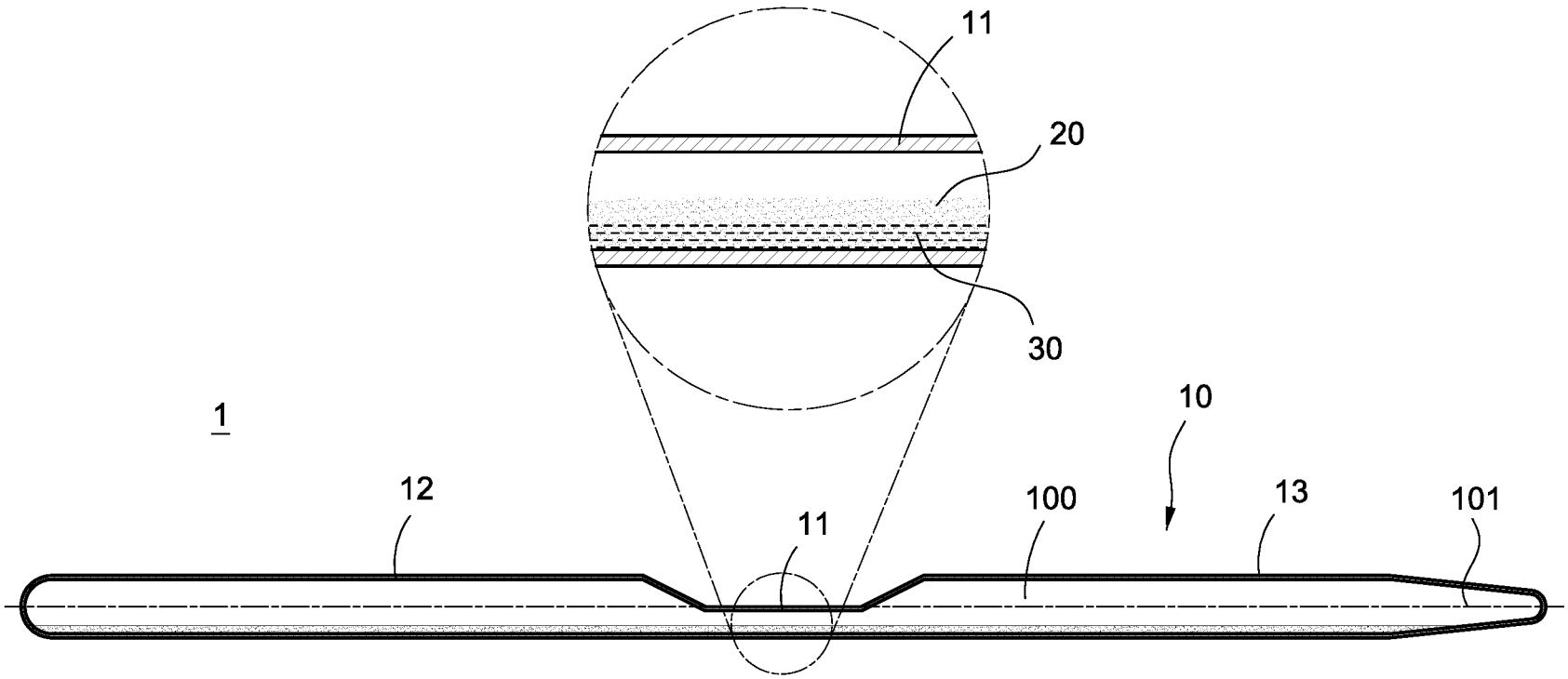
FIG. 2 and FIG. 3 are cross sectional views of heat pipe with adjustable working temperature range in two directions of the present invention.
Figure 3:
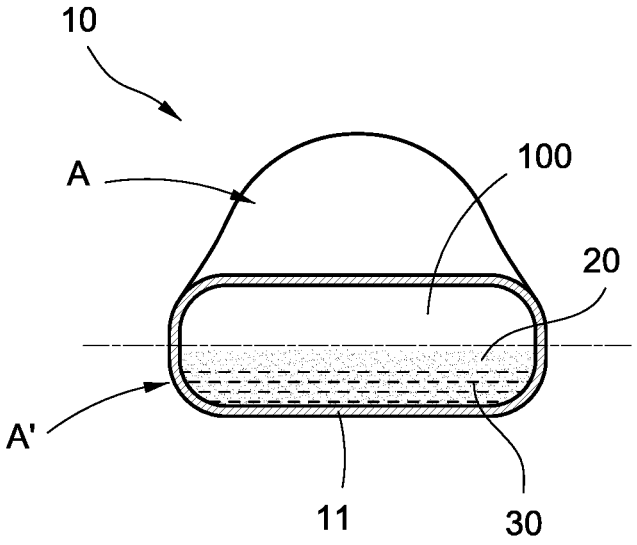

Please refer to FIG. 1 to FIG. 3, which depict a perspective schematic view and two cross sectional views of heat pipe with adjustable working temperature range of the present invention. The heat pipe 1 with adjustable working temperature range includes a tube 10, a capillary structure 20 disposed on an inner wall of the tube, and a working liquid 30 disposed in the tube 10. In addition, the heat pipe 1 is provided for attaching a working object (not shown) for heat exchange. More detail descriptions of the manufacturing method and structure of heat pipe 1 with adjustable working temperature range are as follows.

In the present embodiment, the manufacturing method of the heat pipe 1 includes: a) providing a heat pipe 1, and the heat pipe 1 includes a tube 10, a capillary structure 20 disposed on an inner wall of the tube, and a working liquid 30 disposed in the tube 10. The tube 10 comprises a passage 100 having a length direction 101 and a diameter direction 102 perpendicular to the length direction 101. Besides, the working liquid 30 absorbs heat of the working object and then converts into a vapor phase, and the working liquid 30 passes the passage 100 to perform a condensation reaction and condenses back into the working liquid 30 along the length direction 101. The working liquid 30 moves to a location where the heat pipe 1 attached thereto and absorbs heat of the working object.

Specifically, the tube 10 has a deformation zone 11, a first section 12 and a second section 13 located at opposite sides of the deformation zone 11. Preferably, the deformation zone 11 has a length shorter than that of the first section 12 and the second section 13. It is worthy to note that the length of the deformation zone 11 is not limited, but the resistance of the vapor can be achieved when the vapor passes through the deformation zone 11.

Furthermore, the manufacturing method of heat pipe 1 further includes: b) pressing uniformly on a part of the tube 10 in the pipe diameter direction 102 by a means of processing to form a deformation zone 11, and a pressed cross-sectional area A' of the deformation zone 11 after pressing in the diameter direction 102 is reduced by a reduction ratio P with respect to an original cross-sectional area A before pressing. Thereby, the deformation zone 11 can have a higher fluid resistance, wherein the reduction ratio P of the cross-sectional area of the deformation zone 11 in the diameter direction 102 is determined by the following method.

With furthering, the manufacturing method of heat pipe 1 also includes: c) setting the heat pipe 1 being capable of performing heat exchange of the working object in an ambient temperature range and making a working temperature of the working object to be in a target working temperature range.

Moreover, the manufacturing method of heat pipe 1 also includes: d) providing a testing chamber and disposing the heat pipe 1 with the working object attached thereto, wherein a temperature of the testing chamber is controlled at the ambient temperature range. Besides, the manufacturing method of heat pipe 1 includes: e) operating the working object at the ambient temperature range in the testing chamber and measuring an actual temperature range during the operation of the working object. At last, the manufacturing method of heat pipe 1 includes: f) reducing a cross-sectional area of the passage 100 in the pipe diameter direction 102 by the reduction ratio P, so that the actual temperature range will fall within the target working temperature range.

In real practice, the reduction ratio P is set to be 25% to 75%, and the reduction ratio P can be adjusted according to the actual temperature range of the working object during operation. For example, when the reduction ratio P is set to be 75%, it means that the pressed cross-sectional area A' after pressing is only 25% of the original cross-sectional area A.

In more detail, the ambient temperature range includes a high ambient temperature and a low ambient temperature; besides, in e), the actual temperature range includes a high actual temperature and a low actual temperature. Moreover, the high actual temperature is an operating temperature of the working object when the testing chamber is operated at the high ambient temperature, and the low actual temperature is another operating temperature of the working object when the testing chamber is operated at the low ambient temperature. It is worthy to note that, the operating temperature of the working object is measured under a normal loading.

For example, in the present embodiment, when the heat pipe 1 is operated at the low ambient environment temperature, such as the original cross-sectional area A of the tube 10 of the heat pipe 1 is set to be 0.015 $cm^2$, and the temperature difference between the evaporation section and the condensation section is very small of 2.27° C. Then a portion of the heat pipe 10 is uniformly pressed in the pipe diameter direction 102 to form the deformation zone 11. The pressed cross-sectional area A' of the deformation zone 11 in the pipe diameter direction 102 is reduced by 25%, 50%, and 75% separately with respect to the original cross-sectional area A before pressing, thus, the pressed cross-sectional area A' will account for 75%, 50%, and 25% of the original cross-sectional area A to be 0.012 $cm^2$, 0.008 $cm^2$, and 0.004 $cm^2$ respectively. In addition, the temperature difference between the evaporation section and the condensation section will increase to be 3.03 □, 4.55 □ and 9.10 □ respectively.

We can learn from the above example that, the tube 10 of the heat pipe 1 is partially pressed uniformly in the tube diameter direction 102 to form a deformation zone 11. For example, when the reduction ratio is 75% (that is, the pressed cross-sectional area A' accounts for 25% of the original cross-sectional area A), the temperature difference between the evaporation section and the condensation section will be increased to 9.10° C. At this time, the temperature difference between the evaporation section and the condensation section of the heat pipe 1 is increased to reduce the heat dissipation efficiency when the heat pipe 1 is attached to the working object for heat exchange. Therefore, the heat pipe 1 starts heat exchange after the working object reaches a certain temperature, so that the heat pipe 1 can be operated under a certain working temperature range. Thereby the working temperature of the working object will be increased to an appropriate working temperature to work.

In addition, please refer to the following table, which shows the experimental data obtained from the heat pipe manufactured by the aforementioned method.

| H (mm) | TL (□) | TH (□) | ΔT (□) |
|---|---|---|---|
| 2.0 | 23.9 | 78.7 | 54.8 |
| 0.7 | 30.6 | 78.7 | 48.1 |
| 0.4 | 37.6 | 80.5 | 42.9 |

The above table can be checked in conjunction with FIG. 3. The height of the heat pipe 1 is 2 mm before pressing; furthermore, the temperature (low actual temperature TL) measured on the surface of the working object, a processor for example, is 23.9° C. when the heat pipe 1 is operated at 0° C. of a low ambient temperature before the heat pipe 1 is pressed. Additionally, the temperature (high actual temperature TH) measured on the surface of the working object, a processor for example, is 78.7° C. when the heat pipe 1 is operated at 70° C. of a high ambient temperature. Accordingly, the temperature difference ΔT between the low actual temperature TL and the high actual temperature TH of the working object is 54.8° C.

Moreover, when the heat pipe 1 is uniformly pressed to reduce the heat pipe height H to be 0.7 mm (about one third of the original height), the temperature difference ΔT between the low actual temperature TL and the high actual temperature TH of the working object is 48.1° C. Similarly, when the heat pipe 1 is uniformly pressed to reduce the heat pipe height H to be 0.4 mm (about one-fifth of the original height), the temperature difference ΔT between the low actual temperature TL and the high actual temperature TH of the working object is 42.9° C.

It can be known from the above experimental data that the internal space of the heat pipe 1 of the present invention becomes small after being uniformly pressed. In this case, both the low actual temperature TL and the high actual temperature TH of the heat pipe 1 are increased. Moreover, the increase of the low actual temperature TL allows the working object to reach a certain temperature before the heat exchange begins. In addition, the temperature difference ΔT of the heat pipe 1 is reduced when it operates at a higher temperature of the high ambient temperature and low ambient temperature.

It should be noted that, in the present invention, when the heat pipe 1 is in a high temperature environment, the internal pressure of the heat pipe 1 is increased by phase changes of the working fluid, so that the working vapor can be pushed quickly from the evaporation section to the condensation section because of the high-temperature vapor having characteristic of a large volume. Therefore, the heat conduction efficiency can be improved, and the evaporation section and the condensation section will have a small temperature difference. In this way, the working object can be prevented from being overheated and damaged, and the system performance efficiency will not be deteriorated.

In addition, the heat pipe 1 of the present invention is subjected to the foregoing method and plural tests. When a user sets the target working temperature range, the reduction ratio P can be obtained through a computer program.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A manufacturing method of heat pipe with adjustable working temperature range, comprising:

a) providing a heat pipe for attaching a working object for heat exchange; the heat pipe including a tube, a capillary structure disposed on an inner wall of the tube, and a working liquid disposed in the tube; the tube comprising a passage having a length direction and a diameter direction being perpendicular to the length direction; the working liquid absorbing heat of the working object and then converting into a vapor phase, and the working liquid passing the passage to perform a condensation reaction along the length direction and condensing back into the working liquid; the working liquid moving to a location where the working object attached thereto through the capillary structure and absorbing heat of the working object;

b) pressing uniformly on a part of the tube in the pipe diameter direction to form a deformation zone, and a pressed cross-sectional area of the deformation zone after being pressed in the diameter direction being reduced by a reduction ratio with respect to an original cross-sectional area before the deformation zone being pressed, so that the deformation zone has a higher fluid resistance, wherein the reduction ratio of the pressed cross-sectional area of the deformation zone in the diameter direction is determined by the following method:

c) setting the heat pipe being capable of performing heat exchange of the working object in an ambient temperature range and making a working temperature of the working object to be in a target working temperature range;

d) providing a testing chamber and disposing the heat pipe with the working object attached thereto, wherein a temperature of the testing chamber is controlled at the ambient temperature range;

e) operating the working object at the ambient temperature range in the testing chamber and measuring an actual temperature range during the operation of the working object; and f) reducing a cross-sectional area of the passage in the pipe diameter direction by the reduction ratio, so that the actual temperature range will fall within the target working temperature range.

2. The manufacturing method of heat pipe with adjustable working temperature range according to claim 1, wherein the tube includes the deformation zone, a first section and a second section located at opposite sides of the deformation zone; the deformation zone has a length shorter than that of the first section and the second section.

3. The manufacturing method of heat pipe with adjustable working temperature range according to claim 1, wherein in c), the ambient temperature range includes a high ambient temperature and a low ambient temperature; in e), the actual temperature range includes a high actual temperature and a low actual temperature; the high actual temperature is an operating temperature of the working object when the testing chamber is operated at the high ambient temperature, and the low actual temperature is another operating temperature of the working object when the testing chamber is operated at the low ambient temperature.

4. The manufacturing method of heat pipe with adjustable working temperature range according to claim 1, wherein in e), the operating temperature of the working object is measured under a normal loading.

5. The manufacturing method of heat pipe with adjustable working temperature range according to claim 1, wherein the reduction ratio is 25% to 75%.

6. The manufacturing method of heat pipe with adjustable working temperature range according to claim 5, wherein the reduction ratio is 75%.

* * * * *